US010995617B2

(12) United States Patent
Protiva et al.

(10) Patent No.: US 10,995,617 B2
(45) Date of Patent: May 4, 2021

(54) MINING ROCK DEFLECTOR APPARATUS AND METHOD

(71) Applicant: Swanson Industries, Inc., Morgantown, WV (US)

(72) Inventors: Edward Protiva, Bellaire, OH (US); Jessica Larew, Tunnelton, WV (US); Peter Singleton, Canonsburg, PA (US)

(73) Assignee: Swanson Industries, Inc., Morgantown, WV (US)

( * ) Notice: Subject to any disclaimer, the term of this patent is extended or adjusted under 35 U.S.C. 154(b) by 0 days.

(21) Appl. No.: 17/008,051

(22) Filed: Aug. 31, 2020

(65) Prior Publication Data

US 2020/0400020 A1 Dec. 24, 2020

Related U.S. Application Data

(63) Continuation of application No. 15/982,280, filed on May 17, 2018, now Pat. No. 10,808,533.

(51) Int. Cl.
*E21D 23/00* (2006.01)
*E21D 23/06* (2006.01)

(52) U.S. Cl.
CPC ..... *E21D 23/063* (2013.01); *E21D 23/0043* (2013.01)

(58) Field of Classification Search
CPC ..... E21D 17/01; E21D 17/02; E21D 17/0206; E21D 17/082; E21D 19/02; E21D 23/043; E21D 23/063; E21D 23/066; E21D 23/03
See application file for complete search history.

(56) References Cited

U.S. PATENT DOCUMENTS 3,399,927 A * 9/1968 Groetschel ..... E21D 17/0206 299/11
3,466,875 A * 9/1969 Groetschel ..... E21D 17/02 405/293
3,672,174 A * 6/1972 Von Hippel ..... E21D 23/0017 405/295
3,877,234 A * 4/1975 Martinko ..... E21D 23/06 405/295
4,048,803 A * 9/1977 Bole ..... E21D 23/063 405/296
4,269,546 A * 5/1981 Saunders ..... E21D 23/066 405/294
4,411,558 A * 10/1983 Rutherford ..... E21D 23/063 405/294
4,427,321 A * 1/1984 Weirich ..... E21D 23/16 405/294
4,430,026 A * 2/1984 Hill ..... E21D 23/063 299/33

* cited by examiner

*Primary Examiner* — Benjamin F Fiorello
*Assistant Examiner* — Stacy N Lawson
(74) *Attorney, Agent, or Firm* — Richard W. James

(57) ABSTRACT

An apparatus and method for protecting a person servicing a longwall shear such changing bits on a drum, embodiments relating to a base plate to be secured to an underside of a shield canopy and a slide plate movably connected to the underside of the base plate such that the slide plate can advance out from the shield canopy to allow a person to service a longwall shear while being protected by the slide plate from falling rock and other debris, and the slide plate can then retract back under the shield canopy.

13 Claims, 8 Drawing Sheets

MINING ROCK DEFLECTOR APPARATUS AND METHOD

CROSS-REFERENCE TO RELATED APPLICATIONS

The present application is a continuation of U.S. patent application Ser. No. 15/982,280, filed May 17, 2018, which is incorporated herein in its entirety.

FIELD OF THE INVENTION

This invention is related to mining, and more particularly to an apparatus and method for protecting one or more persons from falling rock and debris during longwall mining.

BACKGROUND OF THE INVENTION

During longwall mining, a drum of a longwall shear advances along a wall of coal, shearing off a layer of coal for collection. Mine roof supports, such as shield canopies of mine roof support systems, contact the mine roof during the shearing operation to prevent roof collapse. The shield canopies may not be positioned over the drum to avoid interference, but may instead be positioned just behind the drum. Therefore, the portion of the mine roof directly above the drum may be exposed. As the shear operation advances the mine face, some shield canopies have extensions that can rotate up from, or extend from within, those shield canopies to correspondingly extend the roof supports so they continue to be positioned just behind the drum.

Periodically, a technician services the longwall shear, such as by changing the cutting bits on the drum. Though the exposed mine roof area directly above the drum may not be in danger of collapse, a danger of falling rock or debris still exists.

However, extending a roof support extension directly over the drum to protect the technician when he or she is positioned at the drum has drawbacks. For example, a hinged, rotatable extension on a shield canopy may swing into place via hydraulic cylinders mounted to the underside of that extension. Absent a significant clearance, the rotating of that extension may interfere with the drum. Further, the cylinders may interfere with the drum as they increase the thickness of the extension machinery below the shield canopy. Similarly, an extension that extends from within a shield canopy causes the shield canopy to be thicker, as the shield canopy has layers on either side of the extension. Such a configuration also leaves less space for the drum underneath. Roof support extensions such as those above may assume too much space to protect against falling rock and debris when used in, for example, thin coal seams, such as those in the eastern United States, or in other mining operations with space constraints.

There may therefore be a need for an extension on a shield canopy that by configuration and movement lessens the chance of interference with the drum when extended overhead of the drum, such as when used on thin coal seams or in other mining operations where space is limited. There may also be a need for an extension on a shield canopy to protect a technician from falling debris or rock when the technician is servicing a longwall shear, but which may not contact a mine roof as support against collapse.

BRIEF DESCRIPTION OF THE DRAWINGS

The accompanying drawings, wherein like reference numerals are employed to designate like components, are included to provide a further understanding of apparatuses and methods for protecting a person servicing a longwall shear, are incorporated in and constitute a part of this specification, and show embodiments of those apparatuses and methods that together with the description serve to explain those apparatuses and methods.

Various other objects, features and advantages of the invention will be readily apparent according to the following description exemplified by the drawings, which are shown by way of example only, wherein.

SUMMARY OF THE INVENTION

In an embodiment, an apparatus for protecting a person servicing a longwall shear includes: a base plate to be secured to an underside of a shield canopy, the base plate comprising an underside and two sides, each of the two sides comprising a plurality of guides; and a slide plate to be movably secured to the underside of the base plate, the slide plate including a front end and a back end, the slide plate slidable along the plurality of guides of the base plate between positions out from, and back under, the underside of the shield canopy.

In another embodiment, a method of protecting a person servicing a longwall shear includes: sliding a slide plate out from under an underside of a shield canopy toward a face of coal such that the slide plate positions over shearing equipment without contacting a roof adjacent to the face of coal; holding the slide plate over the shearing equipment while maintenance is performed on the shearing equipment; and sliding the slide plate back under the underside of the shield canopy after the maintenance on the shearing equipment has been performed.

Other embodiments, which may include one or more parts of the aforementioned apparatus and method or other parts, are also contemplated, and may thus have a broader or different scope than the aforementioned apparatus and method. Thus, the embodiments in this Summary of the Invention are mere examples, and are not intended to limit or define the scope of the invention or claims.

DETAILED DESCRIPTION

Reference will now be made to embodiments of apparatuses and methods for protecting a person servicing a longwall shear, examples of which are shown in the accompanying drawings. Details, features, and advantages of apparatuses and methods for protecting a person servicing a longwall shear will become further apparent in the following detailed description of embodiments thereof.

Any reference in the specification to "one embodiment," "a certain embodiment," or a similar reference to an embodiment is intended to indicate that a particular feature, structure or characteristic described in connection with the embodiment is included in at least one embodiment of the invention. The appearances of such terms in various places in the specification do not necessarily all refer to the same embodiment. References to "or" are furthermore intended as inclusive, so "or" may indicate one or another of the ored terms or more than one ored term.

Figure 1:
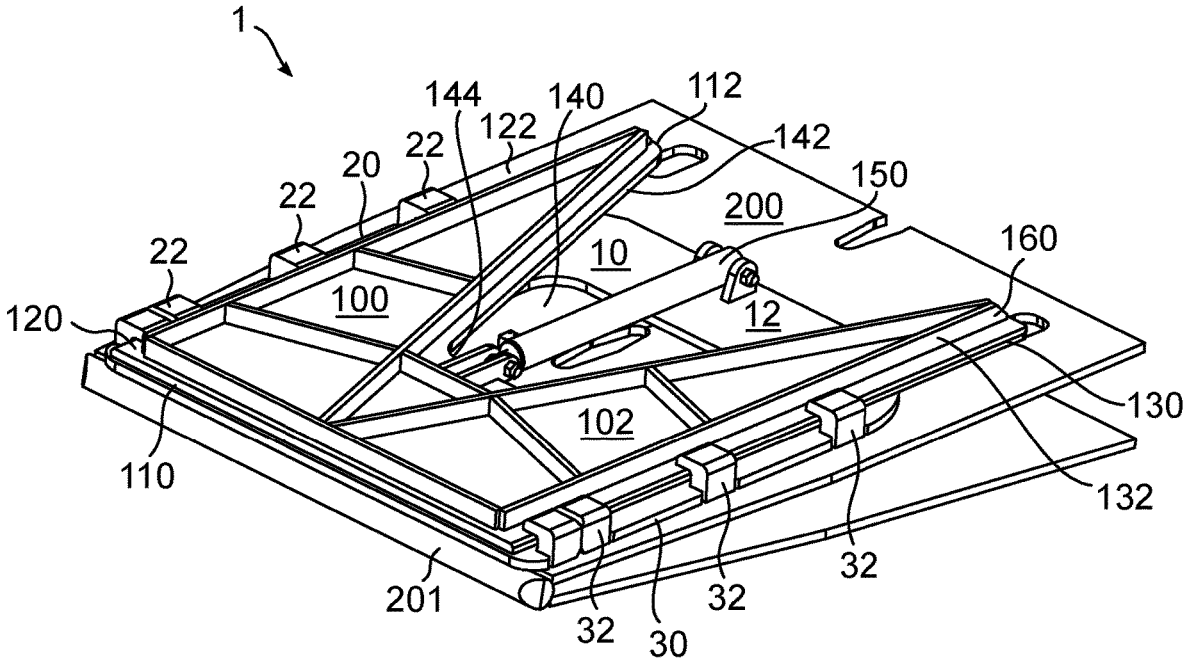
FIG. 1 shows a perspective view of an apparatus for protecting a person servicing a longwall shear during a longwall mining operation, with the slide plate in the unextended position, in accordance with embodiments.
Figure 2:
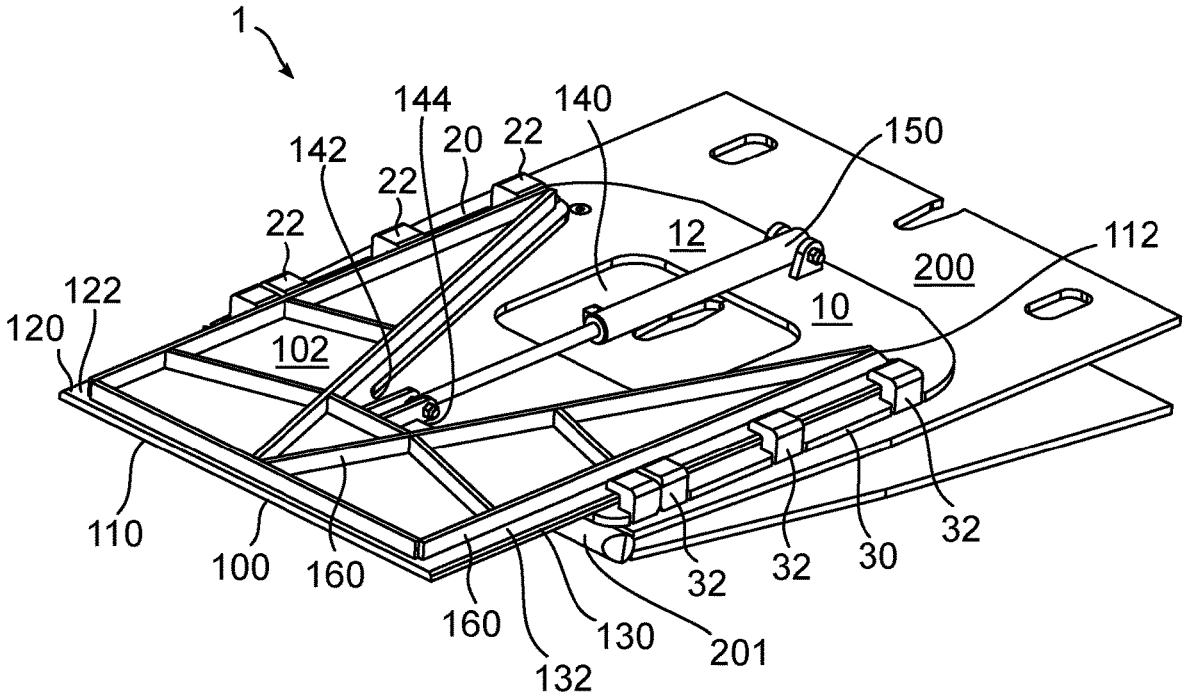
FIG. 2 shows a perspective view of an apparatus for protecting a person servicing a longwall shear during a longwall mining operation, with the slide plate in the extended position, in accordance with embodiments.
Figure 3:
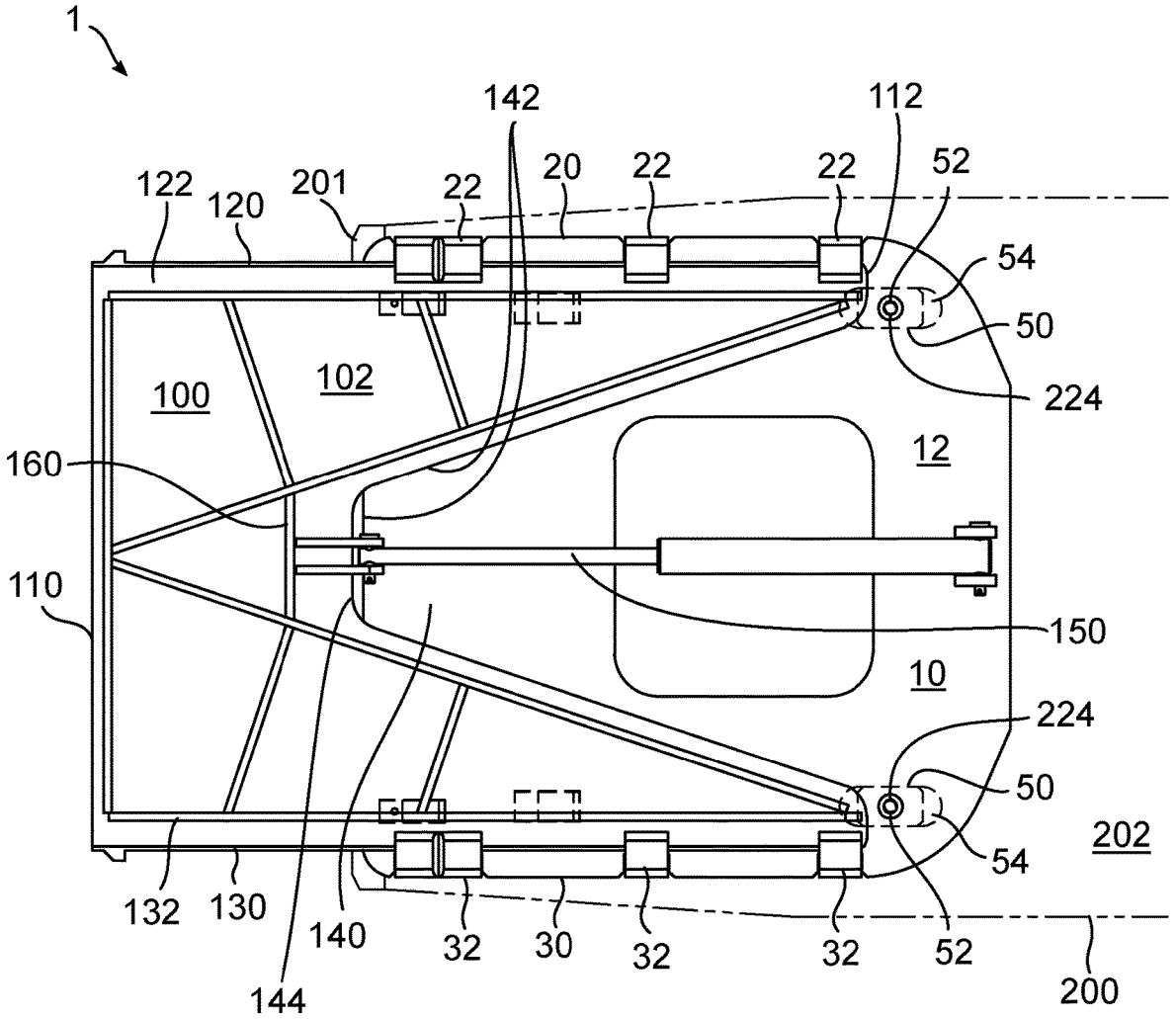
FIG. 3 shows a bottom view of the apparatus for protecting a person servicing a longwall shear during a mining operation, with the slide plate in the extended position, in accordance with embodiments.

FIGS. 1-2 are perspective views of an apparatus 1 for protecting a person servicing a longwall shear during a longwall mining operation, accordance with one embodiment. These perspective views are from below the apparatus 1 when the apparatus 1 is in position in a mine for operation, and thus show the underside of the apparatus 1. The embodiment of FIG. 3 shows a bottom view of the apparatus 1 for protecting a person servicing a longwall shear during a mining operation, and thus also shows the underside of the apparatus 1. The apparatus 1 may include a base plate 10 and a slide plate 100. A shield canopy 200 for longwall mining may be used with the apparatus 1, or in an embodiment the shield canopy 200 may be considered part of the apparatus 1. The shield canopy 200 may be part of a roof support system (not shown) used in longwall mining.

Figure 4:
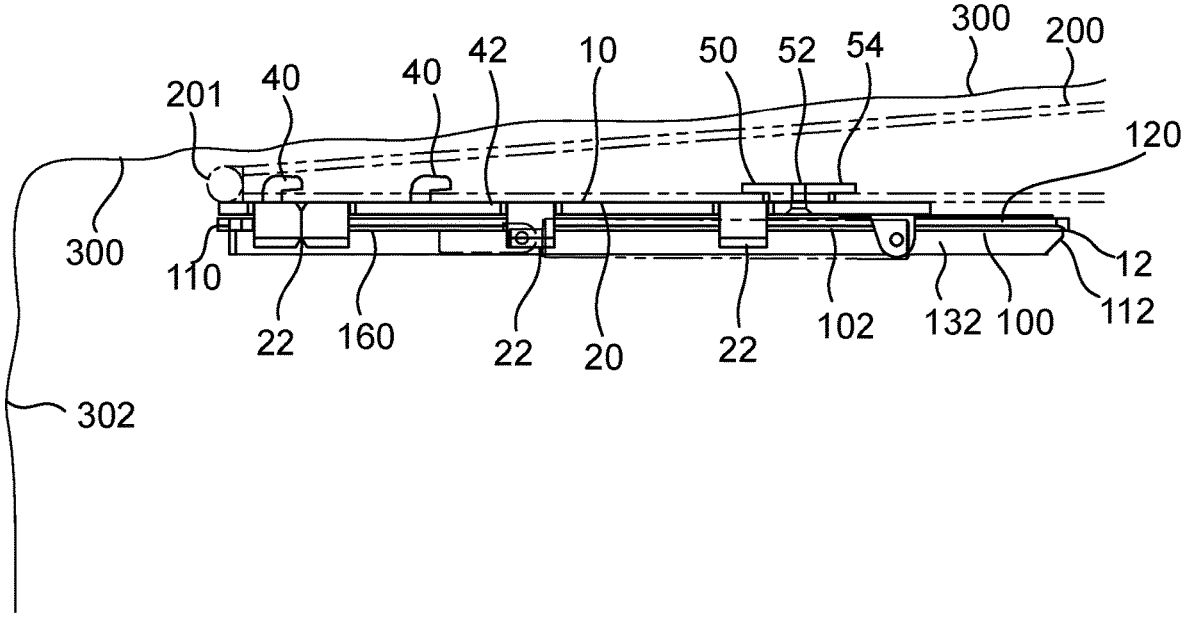
FIG. 4 shows a side view of an apparatus for protecting a person servicing a longwall shear during a mining operation, with the slide plate in the unextended position, in accordance with embodiments.
Figure 5:
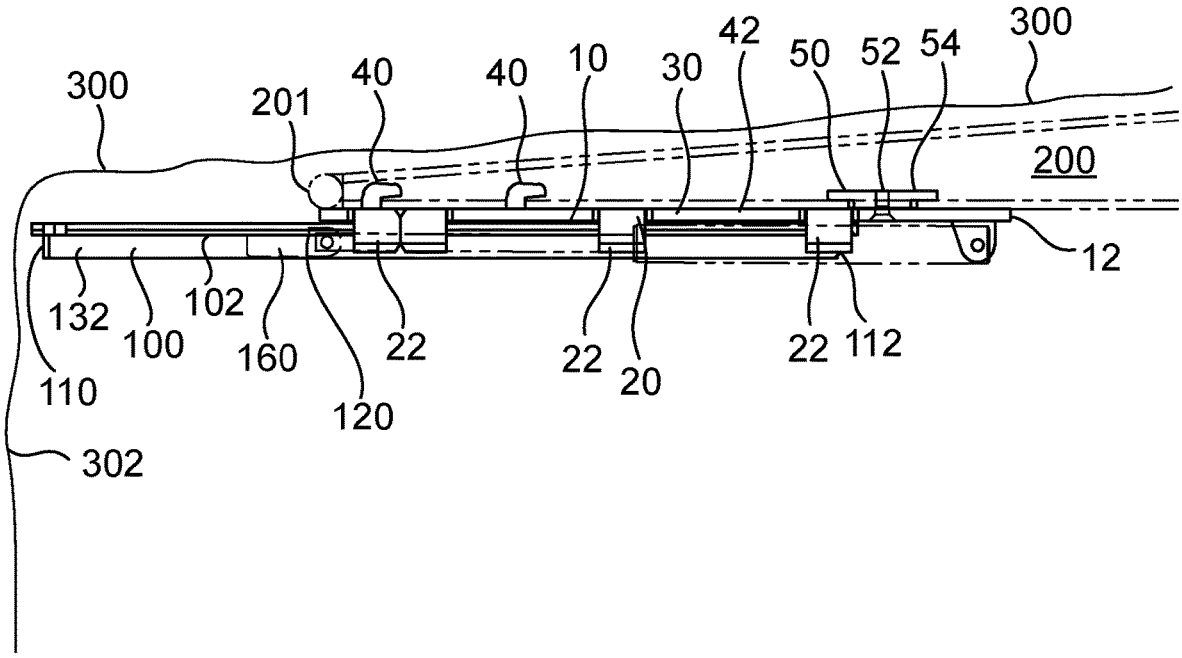
FIG. 5 shows a side view of an apparatus for protecting a person servicing a longwall shear during a mining operation, with the slide plate in the extended position, in accordance with embodiments.

FIGS. 4-5 illustrate two side views, respectively, of an apparatus 1 for protecting a person servicing a longwall shear during a mining operation, accordance with embodiments.

In the embodiments shown in FIGS. 1 and 4, the slide plate 100 of the apparatus 1 is shown in an unextended position. In that position, during a longwall mining operation, the slide plate 100 is under the shield canopy 200 and thus not exposed to the mine roof 300 shown in FIG. 4.

FIGS. 2, 3, and 5 show an embodiment of the apparatus 1 with the slide plate 100 in the extended position. In the extended position, the slide plate 100 is advanced out from the shield canopy 200 such that the slide plate 100 is exposed to the mine roof 300 shown in FIG. 5. In that extended position, the slide plate 100 can protect a person, such as a service technician changing a longwall shear drum positioned under the slide plate 100, from falling rock or other debris. In an embodiment, in the extended position the slide plate 100 is extended about two feet beyond the end 201 of the shield canopy 200, but in other embodiments the extension can be a different length. As shown, in an embodiment, the slide plate 100 in the extended position does not contact the mine roof 300.

Referring to FIGS. 1-5, the base plate 10 of the apparatus 1 may be a structure that is secured, such as described below, to the underside 202 of the shield canopy 200, which may be part of a roof support system (not shown). The underside 12 of the base plate 10 may face away from the mine roof 300. The base plate 10 may have two sides 20 and 30. In an embodiment, side 20 includes a plurality of guides, such as three guides 22 or a different number of guides, and side 30 includes a plurality of guides, such as three guides 32 or a different number of guides. In one embodiment, the plurality of guides 22 and 32 includes at least six guides, and thus at least three guides 22 and at least three guides 32. The guides 22 and 32 of the base plate 10 may be portions of the base plate 10 that extend at least partially around and to the underside 102 of the slide plate 100. Thus, the guides 22 and 32 (and thus the base plate 10) may partially or fully support the slide plate 100 against gravity. The guides 22 and 32 of the base plate 10 may further allow the slide plate 100 to advance by sliding out from under the shield canopy 200 toward a face of coal 302 and retract by sliding back under the shield canopy 200, as described below. Thus, the slide plate 100 may be movably secured to the underside 12 of the base plate 10, and thus movably secured to the base plate 10. As so movably secured, the underside 102 of the slide plate 100 may face away from the mine roof 300. The use of guides 22 and 32 to secure the slide plate 100 versus a bulkier securing structure allows the apparatus 1 to occupy less space and thus interfere less with longwall mining machinery underneath. Use of such less bulky securing structures may be possible because the slide plate 100 itself may be less bulky and weigh less than if used as a roof extension, as the slide plate 100 does not need to be sturdy enough to secure a mine roof against collapse, but only sturdy enough to shield against falling rock or other debris. Additionally, the guides 22 and 32 may weigh less than a bulkier securing structure and thus provide for a more efficient structure by way of less weight.

In an embodiment, the guides 22 and 32 of the base plate 10 may be L-shaped members whose bottom part of the "L" extends at least partially around the slide plate 100 to the underside 102 of the slide plate. Those L-shaped members may be slender relative to the length of the sides 120 and 130 of the slide plate 100. Those L-shaped members may be relatively slender because they are supporting a slide plate 100 that is for rock and debris deflection, and may not contact the mine roof 300 to provide roof support. In other embodiments, the guides 22 and 32 may be otherwise shaped to extend at least partially around and to the underside 102 of the slide plate 100.

Figure 6:
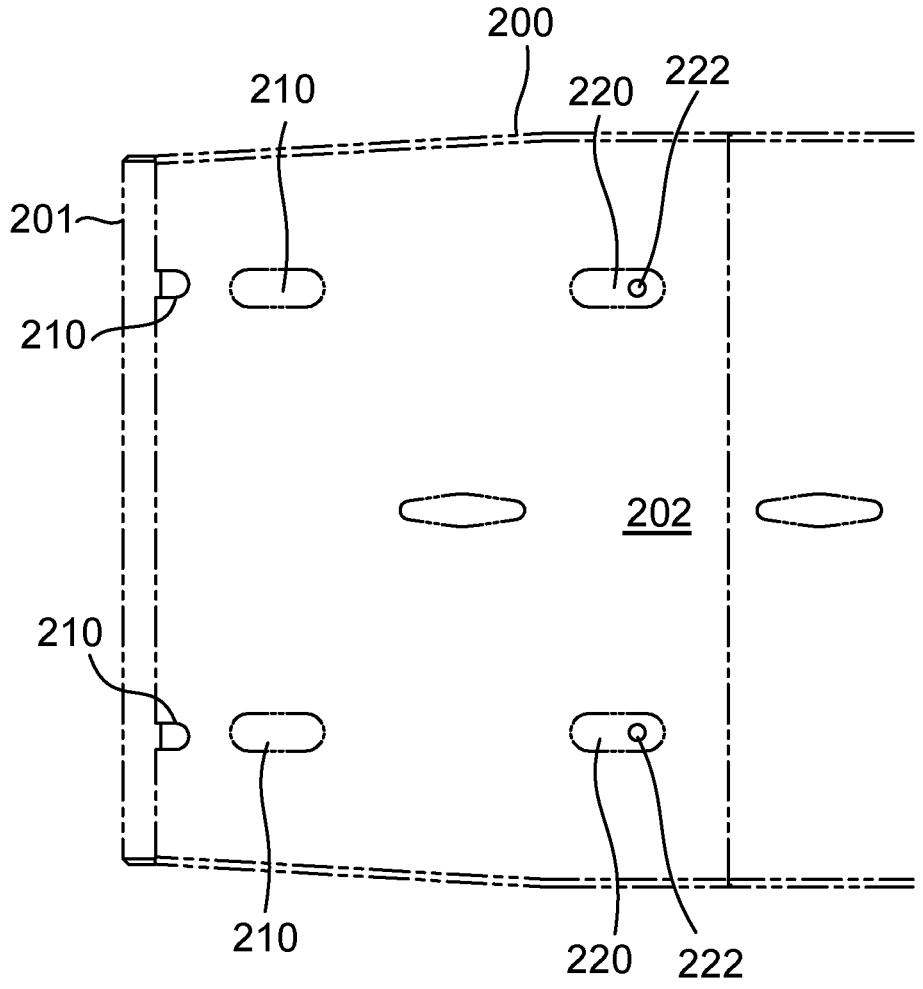
FIG. 6 shows a bottom view of a shield canopy that may be part of or used with the apparatus for protecting a person servicing a longwall shear during a mining operation, in accordance with embodiments.
Figure 7:
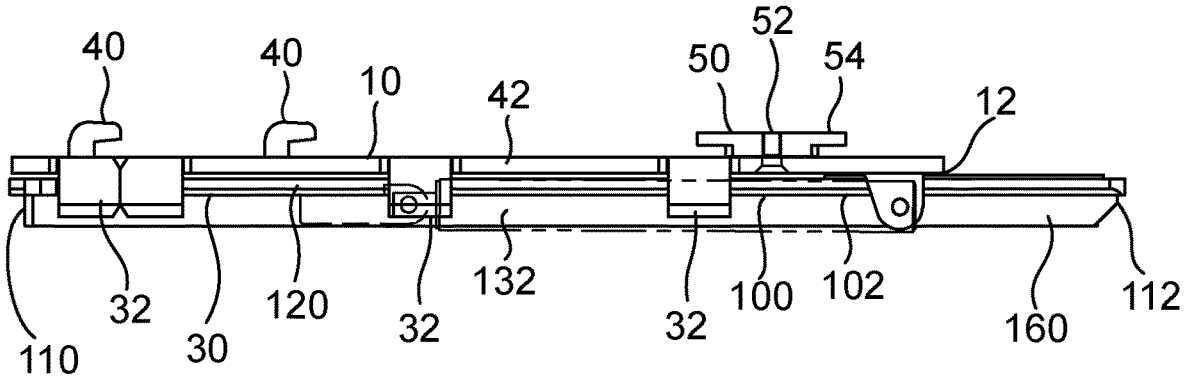
FIG. 7 shows a side view of the apparatus or part thereof for protecting a person servicing a longwall shear during a mining operation, showing the correspondence of the connectors of the base plate with holes of the shield canopy.

The base plate 10 may be secured to the shield canopy 200 with a plurality of connectors of the base plate 10 that each extend into a different one of a plurality of holes 210 and 222 of the shield canopy 220. Holes 210 and 222 are shown in FIG. 6, which illustrates a bottom (underside) view of the shield canopy 200, in accordance with an embodiment. FIG. 7 shows an accompanying side view of the base plate 10 and slide plate 100 of the apparatus 1, showing the correspondence of the connectors of the base plate 10 with the holes 210 and 222 of the shield canopy 220.

In an embodiment, the plurality of connectors of the base plate 10 include a plurality of hooks 40, such as four hooks 40 (two hooks 40 can be seen in FIGS. 4-5, for example, and two more hooks 40 are aligned in those views and cannot be seen) extending from the top side 42 of the base plate 10. The plurality of connectors of the base plate 10 may also include one or more, such as two (two can be seen in FIG. 3), threaded bolt blocks 50 that extend from the top side 42 of the base plate 10. The threaded bolt blocks 50 may include threaded holes 52 and hooks 54. The hooks 40 may hook around holes 210 in the underside 202 of the shield canopy 200 while the threaded bolt blocks 50 hooks 54 may hook around other shield canopy 200 holes 220 in the underside 202. In such a position, the threaded holes 52 of the threaded bolt blocks 50 may align with the threaded holes 222 of the shield canopy 200 holes 220. A threaded bolt 224, such as shown in FIG. 3, may then be threaded through each of the aligned threaded holes 52 and 222 to secure the base plate 10 to the shield canopy 200. That mechanism of attachment provides an efficient means of securing the apparatus 1 to the shield canopy 200, and unsecuring the same in case the apparatus 1 is unneeded in certain mining operations. The threaded bolts 224 may be 30 mm diameter bolts and fit into correspondingly-sized threaded holes 222 of the shield canopy 200 holes 220, or other dimensions may be used. In other embodiments, the base plate 10 may be otherwise secured to the shield canopy 200.

The slide plate 100 may include a front end 110, a back end 112, and two sides 120 and 130. As introduced above, the slide plate 100 may slide along the guides 22 and 32 of the base plate 10. For example, the slide plate 100 may slide its underside 102, by way of the actuator 150 described herein, along the guides 22 and 32 of the base plate 10. The slide plate 100 may slide out from under the underside 202 of the shield canopy 200 toward a face of coal 302, and slide back under the underside 202 of the shield canopy 200, The slide plate 100 may have a void 140 defined by its periphery 142. The void 140 may be cut into the back end 112 of the slide plate 100. An actuator 150, which may include one or more devices for moving the slide plate 100, may be secured to the slide plate 100. In an embodiment, the actuator 150 is one hydraulic cylinder. The hydraulic cylinder may have fittings for connecting hoses and a check valve mounted to its ring (retract port). The hydraulic cylinder may be operated with a 2-function control valve that has a restrictor, such as a one mm restrictor, to slow the movement of the slide plate 100 during operation of the apparatus 1. The hydraulic cylinder may have a 25" stroke. The hydraulic cylinder may have other specifications as desired.

The actuator 150 may be activated to slide the slide plate 100, as described herein, out from, and back under, the underside 12 of the base plate 10, and thus out from, and back under, the underside 202 of the shield canopy 200. The actuator 150, in an embodiment, may be secured to the slide plate 100 adjacent to, such as at or near, the periphery 142 of the void 140. As so secured or otherwise secured, the actuator 150 may be disposed at least partially within the void 140. In that position at least partially within the void 140, the actuator 150 may assume less space below the underside 102 of the slide plate 100 than if the actuator 150 were disposed under a solid portion of the underside 102 of the slide plate 100. Such a configuration provides more space underneath for a longwall shear (not shown) or part thereof, such as a drum (not shown). Such extra space may allow the slide plate 100, without interference, to slide overhead of the longwall shear drum in mining operations where space is limited, such as for thin coal seams in the eastern United States. A technician may then service the drum while being shielded by the slide plate 100 from falling rock or other debris from the mine roof 300.

In an embodiment, the hydraulic cylinder or other actuator 150 may further be secured to the base plate 10. In this configuration, the actuator 150 may not only be disposed partially within the void 140 of the slide plate 100, but may run at a small angle or parallel to the underside 102 of the slide plate 100. That positioning may limit space the actuator 150 takes under the underside of the 102 of the slide plate 100, providing extra space underneath for mining operations where space is limited, such as described herein.

In an embodiment, and as discussed herein, the slide plate 100 may not be for mine roof 300 support, but merely to protect a technician or other person from falling rock or other debris. For example, a drum of a longwall shear (not shown) may not be covered by the shield canopy 200, and thus may be exposed to the mine roof 300. Periodically, the bits on the drum are replaced or otherwise serviced. Though there may not be a danger of mine roof 300 collapse above the drum in certain mining operations, there may be a danger of falling rock or debris. Thus, a slide plate 100 that can extend to provide cover against the falling rock or other debris, but does not contact the mine roof 300, may not need to be as sturdy as a shield canopy extension that contacts a mine roof to provide support against collapse.

Embodiments of the apparatus 1 described herein may be space-efficient. For example, embodiments of the apparatus 1 do not pivot into position and thus do not swing down when moving into operational position, and so do not require significant clearance between the drum and other longwall shear equipment. Also, embodiments of the apparatus 1 do not swing or otherwise move up to contact the mine roof 300 as the apparatus 1 is not for supporting the mine roof 300, again limiting the vertical space the apparatus 1 assumes. Additionally, the base plate 10 and slide plate 100 of the apparatus 1 may not be thick for providing mine roof 300 support and are not positioned within a shield canopy. Rather, the base plate 10 and slide plate 100 may be exposed on the underside 202 of the shield canopy 200 without another shield canopy 200 layer underneath the slide plate 100, providing more space-efficiency.

The void 140 of the slide plate 100 also lessens the space and weight of the apparatus 1. In an embodiment, the void 140 of the slide plate 100 may extend, in a direction toward the front end 110 of the slide plate 100, at least halfway to the front end 110. The void 140 may be sized as such to further limit space and weight of the slide plate 100 and apparatus 1 while still allowing the slide plate 100 to sufficiently function to catch falling rock and debris from the mine roof 300.

In an embodiment, the void 140 of the slide plate 100 narrows as it extends from the back end 112 towards the front end 110 of the slide plate 100. In an embodiment, the void 140 may be shaped, at least in part, as a triangle. This configuration may limit space while remaining sufficiently sturdy to withstand falling rock and other debris when the slide plate 100 is in the extended position of FIGS. 2, 3, and 5. In one embodiment such as shown in FIGS. 1, 2, and 5, the void 140 may have the corner closest to the front end 110 of the slide plate 100 be a beveled corner 144. The beveled corner 144 may provide an edge at the periphery of the void 140 adjacent to which the actuator 150 may be secured. Thus, the actuator 150 may be secured at or near the beveled corner 144.

In an embodiment, the slide plate 100 includes a framework 160. The framework 160 may be a network of reinforcing supports for the slide plate 100. The framework 160 may be disposed on the underside 102 of the slide plate 100. The framework 160 may strengthen the slide plate 100 with limited material to limit the weight increase of the slide plate 100. Limiting the slide plate 100 weight provides for energy and cost efficiency, allowing for a more easily moveable slide plate 100. A limited weight slide plate 100 may, for example in an embodiment, be moveable with an actuator 150 that is a single hydraulic cylinder as opposed to multiple hydraulic cylinders. Use of one hydraulic cylinder as opposed to multiple ones also limits the space apparatus 1 assumes.

In an embodiment in which the framework 160 is included, the two sides 120 and 130 of the slide plate 100 may each include a track 122 and 132, respectively. The tracks 122 and 132 may be formed by portions of the underside 102 of the slide plate 100 adjacent to its sides 120 and 130 plus the part of the framework 160 that runs adjacent to and along the sides 120 and 130. The guides 22 and 32 of the base plate 10, in this embodiment, may extend around and to the underside 102 of the slide plate 100 such that guides 22 and 32 slide along the tracks 122 and 132, respectively.

As described above, the shield canopy 200 may be a part of the apparatus 1 for protecting a person servicing a longwall shear during a longwall mining operation, or may not be part of the apparatus 1. The shield canopy 200 may be made of steel, stainless steel, aluminum or another desired material.

Figure 8:
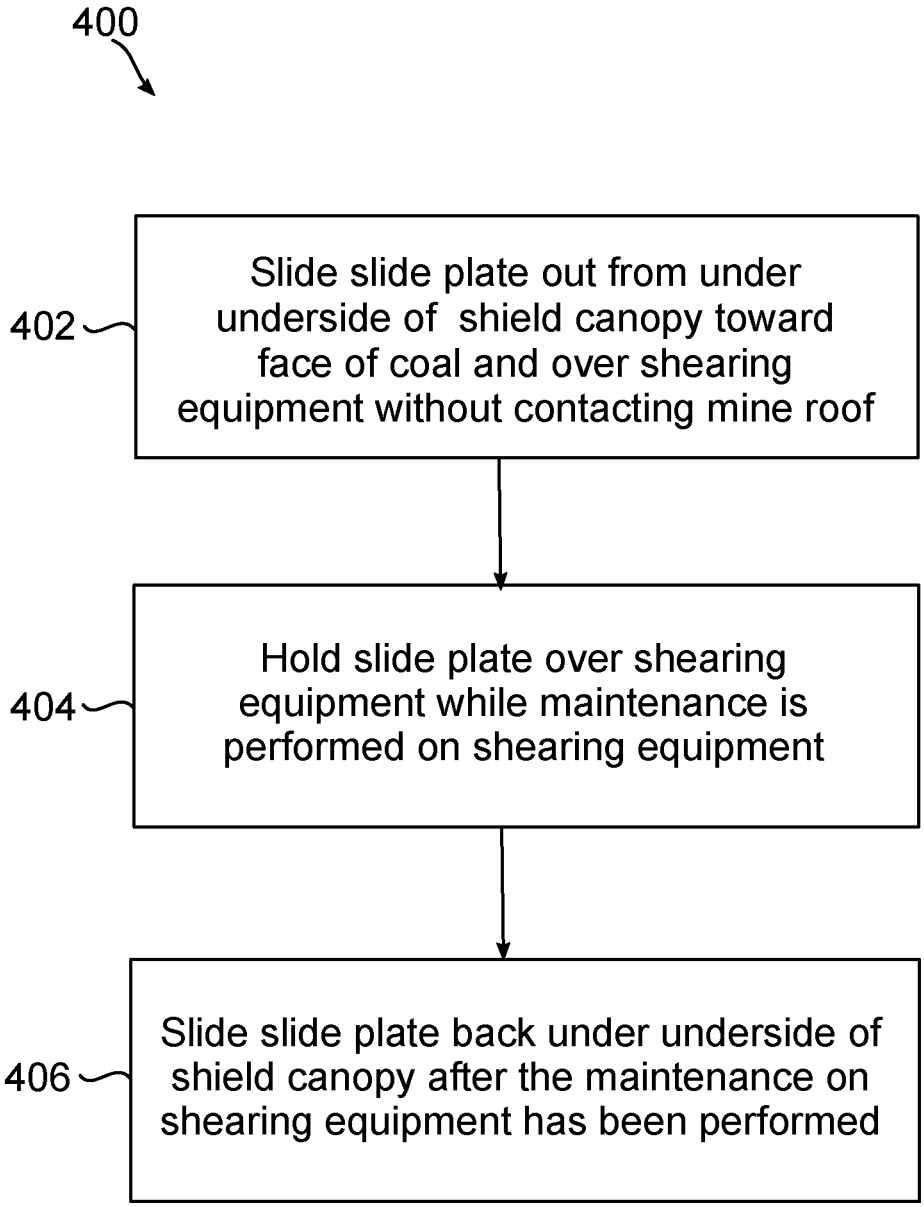
FIG. 8 is a flow chart of a method of protecting a person servicing a longwall shear.

FIG. 8 is a flow chart of a method 400 of protecting a person servicing a longwall shear, in accordance with embodiments. The method 400 may employ one or more embodiments of the apparatus 1, or portions thereof, for protecting a person servicing a longwall shear discussed above with respect to FIGS. 1-7, and the elements of the apparatus 1 from those FIGS. will be referred to in this method 400. The method 400 may include, at 402, sliding a slide plate 100 out from under the underside 202 of a shield canopy 200 toward a face of coal 302 and over shearing equipment such as a drum (not shown). The slide plate 100 at 402 may be advanced as discussed above, by way of the actuator 150, such as a hydraulic cylinder, sliding the underside 102 of the slide plate 100 along the guides 22 and 32 of the base plate 10 that is attached to the underside 202 of the shield canopy 200. Those guides 22 and 32 may extend at least partially around and to the underside of the slide plate 100. At 402, and as discussed above, the slide plate in an embodiment may slide, as described above, without contacting a mine roof 300 adjacent to the mine face 302. As such, the slide plate 100 may not be for mine roof 300 support, but for protecting a person underneath from falling rock or other debris from the mine roof 300.

At 404, the slide plate 100 is held over the shearing equipment while a technician or other person performs maintenance on the shearing equipment. For example, at 304 a technician may move to and then change the cutting bits on a drum in which the slide plate 100 has been advanced out from under the shield canopy and over the drum. The slide plate 100 may deflect rock or other debris that falls overhead from the mine roof 300, thus protecting the technician's hands, for example, from being hit with the debris.

At 406, after the technician has performed the maintenance on the drum or other shearing equipment, such as replacing bits on the drum, the technician moves away from the drum and then the slide plate 100 is slid back under the underside 202 of the shield canopy 200. As described above, in an embodiment, that retraction may be by way of the actuator 150 sliding the slide plate 100 by its underside 102 over the guides 22 and 32, respectively, of the base plate 10.

In one embodiment of the method 400 at 402 and 406, having the slide plate 100 move along the underside 202 of the shield canopy 200 as opposed to, for example, moving between layers of a shield canopy with one layer underneath a roof support extension, may be space-efficient. The slide plate 100 may be considered herein to move along the underside 202 of the shield canopy 200 as it is positioned under the underside 202, notwithstanding that the slide plate 100 may be directly attached to the base plate 10 and thus the slide plate 100 may or may not directly contact the underside 202. Thus, the slide plate 100 may, at 402 and 406, respectively slide out from and slide back under the underside 202 of the shield canopy 200 by so sliding along the base plate 10 that is secured, such as described above, to the underside 202 of the shield canopy 200.

In an embodiment in which the slide plate 100 includes the framework 160, the framework 160 may form tracks 122 and 132 as described herein. In this embodiment, in the method 400 at 402 and 406, the sliding of the slide plate 100 out from under, and back under, the underside 202 of the shield canopy 200 may be by way of the tracks 122 and 132 of the slide plate 100 sliding along the guides 22 and 32 of the base plate.

In an embodiment of the method 400 at 402 and 406, the actuator 150 that causes the slide plate 100 to advance out from, and retract back under, the shield canopy 200 may be disposed at least partially within a void 140 cut into the back end of the slide plate 100. As described above, having the actuator 150 disposed at least partially within the void 140 may decrease the space the apparatus 1 assumes, which may decrease interference between the slide plate 100 and shearing equipment. In this embodiment at 402 and 406, the actuator 150 may be attached to the slide plate 100 at a periphery 142 of the void 140, such as discussed above. In this embodiment, at 402 the slide plate 100 may be slid out from the under the underside 202 of the shield canopy 200 such that no part of the void 140 in the back end of the slide plate 100 extends past the shield canopy 200. This is shown, for example, in FIGS. 2 and 3, in which the slide plate 100 is in the extended position, but the void 140 is still fully positioned under the shield canopy 200 and thus would not be exposed to the mine roof 300 (e.g., mine roof 300 shown in FIG. 5). Thus, the void 140 of the slide plate 100 does not extend past the end 201 of the shield canopy 200 at any time during the advancement of the slide plate 100.

The embodiments described herein of the apparatus 1 and method 400 for protecting a person servicing a longwall shear, such as from falling rock or other debris from a mine roof overhead, provide for a space and weight-efficient solution. Such space efficiency allows for less material to be used, lowering the cost of the apparatus 1 and corresponding method 400, and such weight efficiency allows for less power to be used for sliding the slide plate 100. Less power may, in turn, allow for use of an actuator 150, to slide the slide plate 100, that is in one embodiment a single hydraulic cylinder as opposed to multiple hydraulic cylinders, further limiting the space used by the apparatus 1 and method 400.

While specific embodiments of the invention have been described in detail, it should be appreciated by those skilled in the art that various modifications and alternations and applications could be developed in light of the overall teachings of the disclosure. Accordingly, the particular arrangements, apparatuses, and methods disclosed are meant to be illustrative only and not limiting as to the scope of the invention.

What is claimed is:

1. A method of protecting a person servicing a longwall shear from falling rock and debris, the method comprising:

slidably attaching a slide plate to an underside of a shield canopy, the slide plate slidable along a plurality of base plate guides extending from a base plate attached to the shield canopy between positions out from, and back under, the underside of the shield canopy;

attaching a first end of an actuator to the slide plate such that the actuator is at least partially positioned in a void in a back end of the slide plate;

attaching a second end of the actuator to the underside of the shield canopy;

sliding a front end of the slide plate out from under the underside of the shield canopy toward a face of coal such that the slide plate positions over shearing equipment without contacting a roof adjacent to the face of coal;

holding the slide plate over the shearing equipment while maintenance is performed on the shearing equipment; and sliding the slide plate back under the underside of the shield canopy after the maintenance on the shearing equipment has been performed.

2. The method of claim 1, wherein the sliding the slide plate out from under and back under the shield canopy comprises sliding the slide plate along the base plate secured to the underside of the shield canopy.

3. The method of claim 2, wherein the base plate further includes a plurality of hooks, each hook extending into different holes in the underside of the shield canopy to secure, at least in part, the base plate to the shield canopy.

4. The method of claim 2, wherein the base plate further includes a plurality of threaded bolt blocks to each extend into different holes on the underside of the shield canopy to secure, at least in part, the base plate to the shield canopy.

5. The method of claim 1, wherein the sliding the slide plate out from under and back under the shield canopy comprises sliding the slide plate along the plurality of base plate guides extending at least partially around and to an underside of the slide plate.

6. The method of claim 5, wherein the sliding the slide plate along the plurality of base plate guides comprises sliding tracks of the slide plate along the plurality of base plate guides.

7. The method of claim 5, wherein the plurality of base plate guides support, at least in part, the slide plate.

8. The method of claim 1, wherein the sliding the slide plate out from under the underside of the shield canopy is completed such that no part of the void in the back end of the slide plate extends past the shield canopy during said sliding.

9. The method of claim 1, wherein the void in the back end of the slide plate extends in a direction toward the front end of the slide plate at least halfway to the front end of the slide plate.

10. The method of claim 1, wherein the void in the back end of the slide plate is shaped, at least in part, as a triangle.

11. The method of claim 1, wherein the void in the back end of the slide plate is shaped, at least in part, as a triangle with one corner beveled, the actuator secured to the slide plate adjacent to the beveled corner.

12. The method of claim 1, wherein the slide plate further includes an underside and a framework, the framework secured to the underside of the slide plate.

13. The method of claim 12, wherein the slide plate further includes two sides and two tracks, the underside of the slide plate and the framework forming each of the two tracks adjacent to a different one of the two sides, the slide plate slidable along the plurality of base plate guides by way of the tracks being slidable along the plurality of base plate guides.

* * * * *